US012221836B2

(12) United States Patent
Atkins et al.

(10) Patent No.: US 12,221,836 B2
(45) Date of Patent: Feb. 11, 2025

(54) POLYCRYSTALLINE DIAMOND COMPACT CUTTER WITH PLOW FEATURE

(71) Applicant: Halliburton Energy Services, Inc., Houston, TX (US)

(72) Inventors: William B. Atkins, Conroe, TX (US); John Harman, Denver, CO (US); Curtis Lanning, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 170 days.

(21) Appl. No.: 17/531,628

(22) Filed: Nov. 19, 2021

(65) Prior Publication Data

US 2023/0160265 A1 May 25, 2023

(51) Int. Cl.
*E21B 10/43* (2006.01)
*E21B 10/567* (2006.01)

(52) U.S. Cl.
CPC ..... *E21B 10/43* (2013.01); *E21B 10/567* (2013.01); *E21B 10/5673* (2013.01); *E21B 10/5676* (2013.01)

(58) Field of Classification Search
CPC ..... E21B 10/5673; E21B 10/5676
See application file for complete search history.

(56) References Cited

U.S. PATENT DOCUMENTS

| | | | | |
|---|---|---|---|---|
| 6,003,623 | A * | 12/1999 | Miess | E21B 10/5735 175/428 |
| 6,672,406 | B2 * | 1/2004 | Beuershausen | E21B 10/55 175/57 |
| 9,243,452 | B2 * | 1/2016 | DiGiovanni | E21B 10/573 |
| 9,376,867 | B2 * | 6/2016 | DiGiovanni | E21B 10/5673 |
| D924,949 | S | 7/2021 | Mortensen | |
| 2010/0084198 | A1 * | 4/2010 | Durairajan | E21B 10/55 175/425 |
| 2016/0032657 | A1 | 2/2016 | Zhang et al. | |
| 2017/0234078 | A1 * | 8/2017 | Patel | E21B 10/55 175/430 |
| 2019/0376346 | A1 * | 12/2019 | Vijayabalan | E21B 10/46 |
| 2021/0131190 | A1 * | 5/2021 | Rahmani | E21B 10/42 |

* cited by examiner

*Primary Examiner* — Blake Michener
(74) *Attorney, Agent, or Firm* — Michael Jenney; C. Tumey Law Group PLLC

(57) ABSTRACT

A cutting element includes a substrate configured to couple to a pocket formed in a blade of a downhole drill bit and a polycrystalline diamond portion secured to the substrate. The polycrystalline diamond portion includes a cutting face, a radial sidewall, and a cutting edge formed at a transition from the radial sidewall to the axial the cutting face. The cutting face includes a plow feature disposed at a center of the cutting face. The plow feature has a face portion and a shoulder portion. The shoulder portion extends radially outward from the face portion and axially downward toward the substrate. Additionally, the cutting face includes a recessed portion extending between the cutting edge and a radially outer edge of the shoulder portion.

18 Claims, 6 Drawing Sheets

POLYCRYSTALLINE DIAMOND COMPACT CUTTER WITH PLOW FEATURE

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of drill bit used to drill wellbores is known as a "fixed cutter" or "drag" bit. Rotary drill bits include cutting elements, such as polycrystalline diamond ("PDC") cutters.

In conventional wellbore drilling, a fixed-cutter drill bit is mounted on the end of a drill string, which may be several miles long. At the surface of the wellbore, a rotary table or top drive may turn the drill string, including the drill bit arranged at the bottom of the hole to penetrate the subterranean formation. As the fixed-cutter drill bit rotates, the cutting elements may shear the subterranean formation. Generally cutting elements have a cutting face and a cutting edge at an outer edge of the cutting face. In some orientations (e.g., a negative back rake angle), the cutting face is configured to engage the subterranean formation.

However, engaging the cutting face of the cutting element (e.g., PDC cutter) with the subterranean formation may wear the cutting face during drilling operations. Further, some subterranean formations (e.g., heterogeneous and/or nodular subterranean formations such as chert) may cause fracturing and/or delamination of the cutting element at the cutting face, which may lead to the development of ring out or core out wear in the fixed-cutter drill bit. Such wear to the cutting elements and/or the fixed-cutter drill bit may hinder the efficiency of drilling operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed are cutting elements (e.g., PDC cutters) for use with downhole drill bits. Aspects of the disclosure include particular plow features formed in a cutting face of the cutting element that are configured engage downhole formations in advance of other portions of the cutting face. The plow feature may crush or fracture the formation prior to the other portions of the cutting face and/or a cutting edge engaging the downhole formation. As such, the inclusion of the plow feature may, for example, reduce fracturing, delamination, or other wear of the cutting elements, which may extend an operational life of the drill bit.

Figure 1:
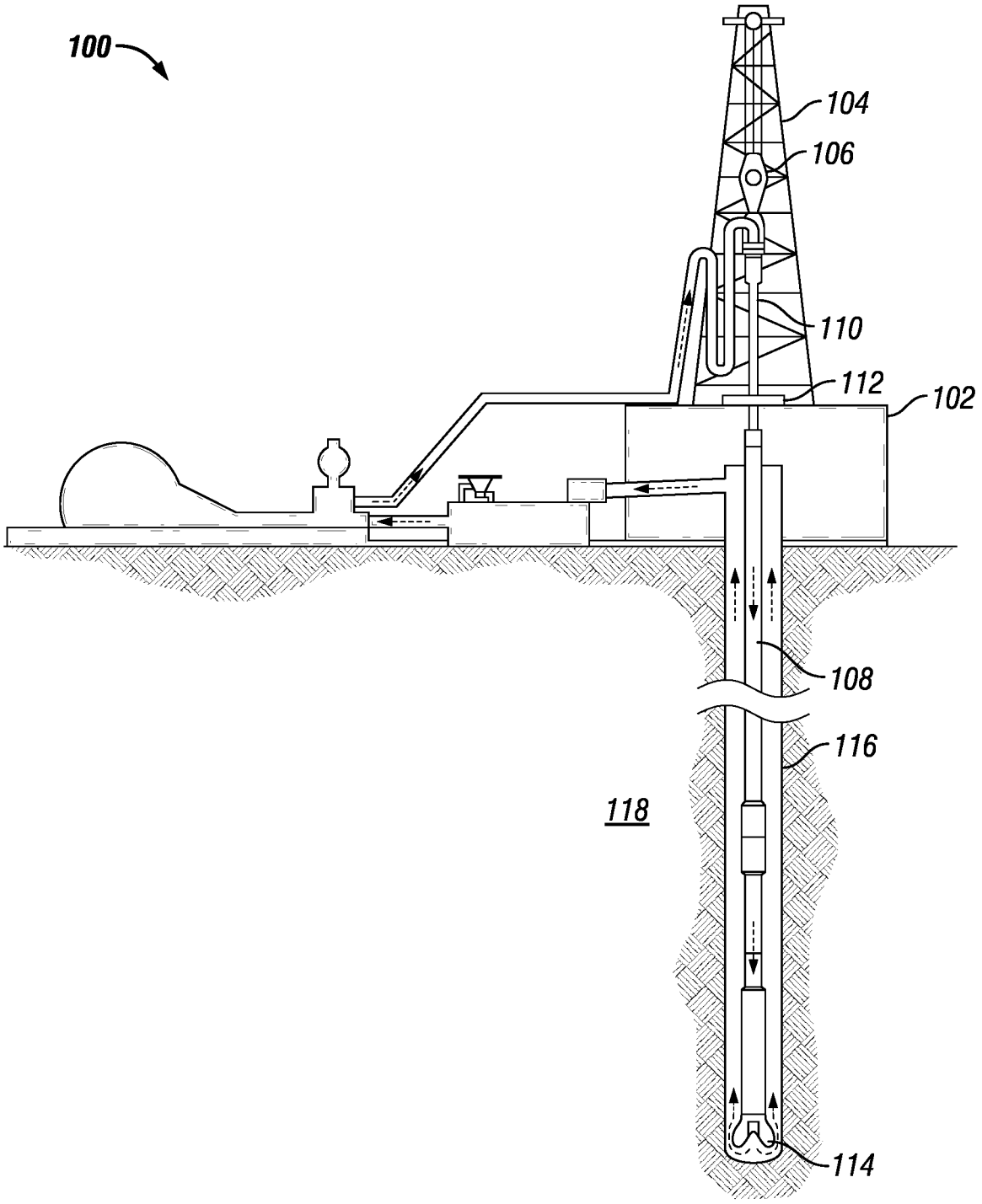
FIG. 1 illustrates a side elevation, partial cross-sectional view of an operational environment, in accordance with some embodiments of the present disclosure.

FIG. 1 illustrates a side elevation, partial cross-sectional view of an operational environment, in accordance with some embodiments of the present disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 is lowered through a rotary table 112 and is used to transmit rotary motion from the rotary table to the drill string 108. A drill bit 114 is attached to the distal end of the drill string 108 and is driven by a downhole motor and/or via rotation of the drill string 108. As the hybrid drill bit 114 rotates, it creates a wellbore 116 that penetrates various subterranean formations 118.

Figure 2:
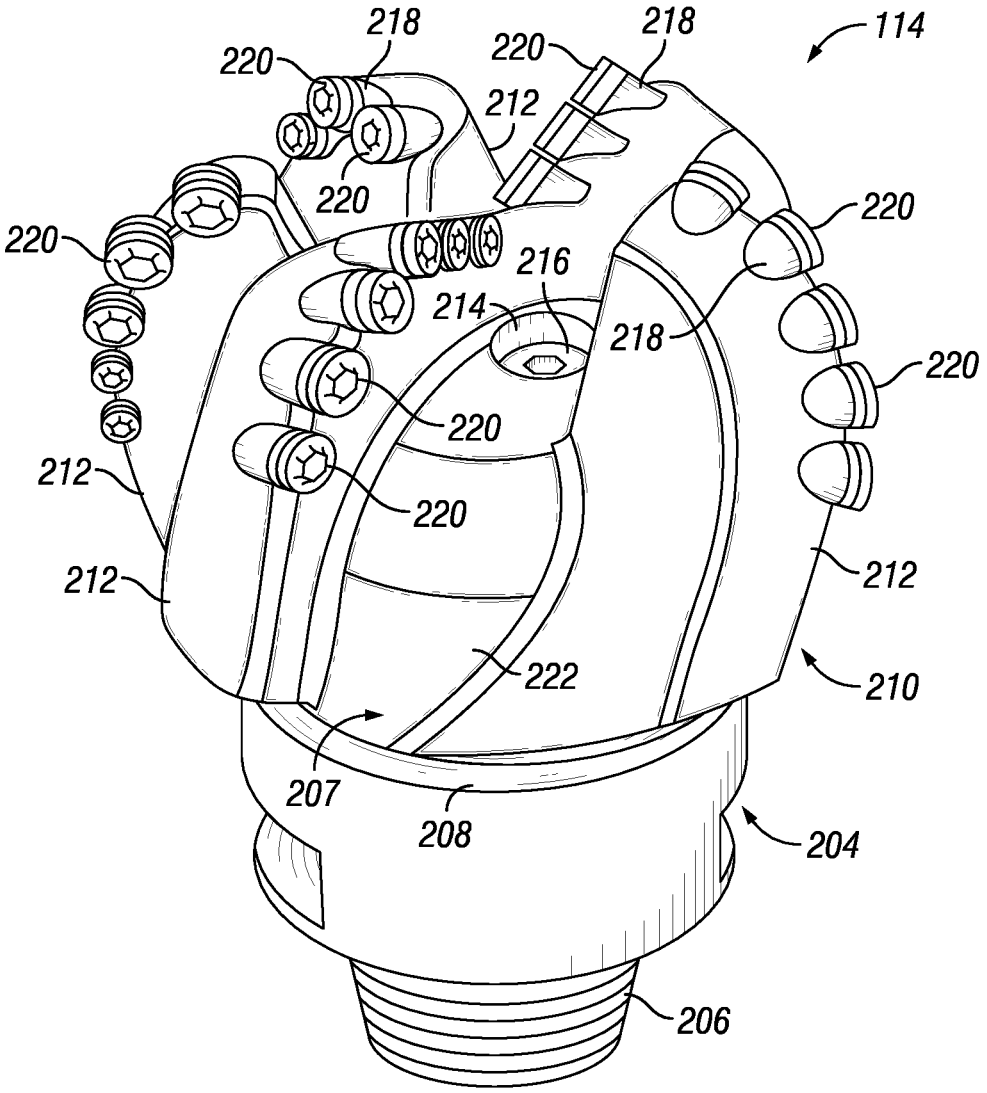
FIG. 2 illustrates a perspective view of a fixed cutter drill bit having a plurality of cutting elements, in accordance with some embodiments of the present disclosure.

FIG. 2 illustrates a perspective view of a fixed cutter drill bit having a plurality of cutting elements, in accordance with some embodiments of the present disclosure. As illustrated, the drill bit 114 has a bit body 210. In some embodiments, the bit body 210 may be formed by a metal-matrix composite (e.g., tungsten carbide reinforcing particles dispersed in a binder alloy). As used herein, the term "drill bit" encompasses rotary drag bits, drag bits, fixed-cutter drill bits, and any other drill bit having a bit body and capable of incorporating the teaching of the present disclosure. A plurality of indentations or pockets 218 are formed in the bit body 210 and are shaped or otherwise configured to receive cutting elements 220 as described herein. The drill bit 114 includes a plurality of cutting elements 220 secured within respective pockets 218. As set forth in detail below, the cutting elements 220 may be comprised of any number of suitable materials including a PDC composition.

Moreover, the drill bit 114 may include a metal shank 204 with a mandrel or metal blank 207 securely attached thereto (e.g., at weld location 208). The metal blank 207 extends into bit body 210. The metal shank 204 includes a threaded connection 206 distal to the metal blank 207. Bit body 210 may include a plurality of blades 212 formed on the exterior of the bit body 210. The blades 212 may be spaced from each other on the exterior of the bit body 210 to form fluid flow paths or junk slots 222 there between.

As illustrated, the plurality of pockets 218 may be formed in the blades 212 in predetermined positions. Each cutting element 220 may be securely mounted (e.g., via brazing) in a respective pocket 218 to engage and remove portions of a subterranean formation during drilling operations. Accordingly, the cutting elements 220 may be positioned on the plurality of blades 212 of the drill bit. Moreover, each cutting element 220 may crush and shear formation materials from the bottom and sides of a well bore during rotation of the drill bit 114 driven by an attached drill string. A nozzle 216 may be positioned in each nozzle opening 214 and positioned to clear cuttings/chips of formation material from cutting elements 220 through evacuation features of the bit 114, including junk slots 222.

Figure 3:
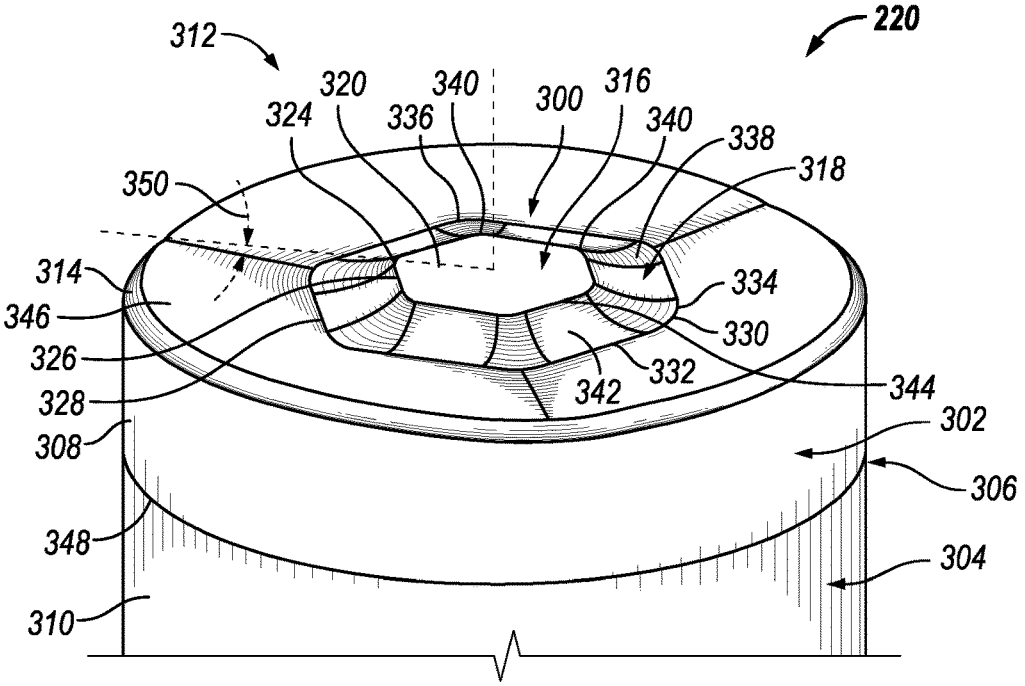
FIG. 3 illustrates a perspective view of a cutting element having a hexagonal plow feature, in accordance with some embodiments of the present disclosure.

FIG. 3 illustrates a perspective view of a cutting element 220 having a hexagonal plow feature 300, in accordance with some embodiments of the present disclosure. The cutting element 220 may be used with the drill bit 114 shown in FIG. 2. However, it will be appreciated that the cutting element 220, as discussed herein, is not limited to use with a fixed-cutter drill bit 114 and may be utilized on any downhole tool, such as drilling casing tools, reading casing tools, hole openers, core heads, coring bits, and back-up cutters. As shown, the cutting element 220 includes a polycrystalline diamond portion 302 secured (e.g., sintered) to a substrate 304. The substrate 304 may include a carbide material (e.g., tungsten carbide). Further, the substrate 304 may include a substantially cylindrical shape configured to at least partially fit within the plurality of pockets 218 set forth above with respect to FIG. 2. Moreover, the polycrystalline diamond portion 302 may be secured to a first axial end 306 of the substrate 304.

In the illustrated embodiment, the polycrystalline diamond portion 302 includes a substantially cylindrical shape having a radial sidewall 308 that is coplanar with a radially outer surface 310 of the substrate 304. Further, the polycrystalline diamond portion 302 includes a cutting face 312 and a cutting edge 314 formed at a transition from the radial sidewall 308 to the cutting face 312. In some embodiments, the cutting face 312 and/or cutting edge 314 are configured to engage the subterranean formation 118 to crush and/or shear formation materials from the bottom and sides of the wellbore 116 during rotation of the drill bit 114.

The cutting face 312 includes a plow feature 300 disposed at the center of the cutting face 312. The plow feature 300 has a face portion 316 and a shoulder portion 318. In the illustrated embodiment, the face portion 316 of the plow feature 300 includes a hexagonal shape. However, as set forth below, the face portion 316 may include geometric shapes (e.g., circular, triangular, etc.) or freeform shapes based at least in part on expected wear conditions in the wellbore 116. For example, the face portion 316 may include a triangular shape to aggressively plow the subterranean formation 118 (i.e., pre-crush the formation in advance of the cutting edge 314 and/or other portions of the cutting face 312 engaging the formation). Alternatively, the face portion 316 may include a circular shape to conservatively plow the subterranean formation 118. However, the circular shape may provide greater durability to fracturing than the triangular shape. Further, as illustrated, the face portion 316 may include a hexagonal shape to semi-aggressively plow the subterranean formation 118 while providing greater durability that the triangular shape.

Moreover, as illustrated, the face portion 316 may have a planar surface 320. Indeed, the face portion 316 may be formed with the planar surface 320 during a sintering process and/or subsequent grinding, lapping, or other material removal processes. Further, lapping procedures and/or laser ablation may finish (e.g., plane, polish, etc.) the planar surface 320 to reduce friction on the face portion 316 during drilling operations. For example, the cutting face 312 may be formed with a substantially planar surface 320 during the sintering process. However, the substantially planar surface 320 may include imperfections. In some embodiments, a lapping procedure may be used to polish or smooth the substantially planar surface 320 of the face portion 316 and remove the imperfections. In another embodiment, the face portion 316 may be planed via laser ablation and then polished or smoothed via a lapping procedure. In a further embodiment, the face portion 316 may be planed, as well as polished or smoothed, via laser ablation.

However, in some embodiments, the face portion 316 may have a non-planar surface (e.g., concave, convex, pyramidal, conical, etc.). The face portion 316 may be formed with the non-planar surface during the sintering process. Alternatively, the non-planar surface may be formed by removing material from the face portion 316. For example, machining, grinding, laser ablation, or other suitable techniques may be used to remove material from the face portion 316 to form the non-planar surface. Further, lapping procedures and/or laser ablation may finish (e.g., plane, polish, etc.) the non-planar surface to reduce friction on the face portion 316 during drilling operations.

In the illustrated embodiment, the shoulder portion 318 of the plow feature 300 extends radially outward from the face portion 316. In some embodiments, the face portion 316 may be symmetrical about a central axis 322 of the cutting element 220. Further, the shoulder portion 318 may be symmetrical about a central axis 322 of the cutting element 220 such that the shoulder portion 318 may extend radially outward from face portion 316 by a same distance from each point of an outer face edge 324 of the face portion 316. Accordingly, the shoulder portion 318 extending radially outward from a hexagonal face portion 316 may have a hexagonal shaped inner shoulder edge 326 (e.g., shared with the outer face edge 324) as well as a hexagonal shaped outer shoulder edge 328. Further, as set forth below, the shoulder portion 318 extending radially outward from a circular face portion 316 may have a circular shaped inner shoulder edge 326 (e.g., shared with the outer face edge 324) as well as a circular shaped outer shoulder edge 328. Indeed, the shoulder portion 318 may have a same shape (e.g., hexagonal) as the face portion 316. However, in some embodiments, some portions (e.g., shoulder corners 330 and shoulder sides 332) of the shoulder portion 318 may extend radially outward further than other portions of the shoulder portion 318. For example, regarding a shoulder portion 318 for a plow feature 300 with a hexagonal shaped face portion 316, a first shoulder corner 334 may extend radially outward further than a second shoulder corner 336 of the shoulder portion 318.

In the illustrated embodiment, the face portion 316 of the plow feature 300 comprises a hexagonal shape. As such, the shoulder portion 318 may have a plurality of ridges 338 extending radially outward from respective face corners 340 of the hexagonal shaped face portion 316 to the radially outer shoulder edge 328 of the shoulder portion 318. Further, the shoulder portion 318 may include a plurality of side portions 342 extending outward from respective sides 344 of the hexagonal shaped face portion 316. The plurality of ridges 338 may include straight edges formed in the shoulder portion 318 between adjacent side portions 342. However, in the illustrated embodiment, the respective face corners 340 of the hexagonal shaped face portion 316 may be rounded or curved. As such, the plurality of ridges 338 may be a rounded transition formed in the shoulder portion 318 between the adjacent side portions 342. Further, a width of each of the ridges 338 may be based at least in part on a radius of the respective face corner 340. In some embodiments, at least one ridge 338 of the plurality of ridges 338 may be configured to engage the subterranean formation 118 to plow the formation material.

Moreover, the shoulder portion 318 may be recessed into the cutting face 312. That is, the shoulder portion 318 may extend in an axially downward from the face portion 316 in a direction toward the substrate 304 as the shoulder portion 318 extends radially outward from the face portion 316. The shoulder portion 318 may be formed by removing material from the cutting face 312. For example, machining, grinding, laser ablation, or other suitable techniques may be used to remove material from the cutting face 312 to form the shoulder portion 318. In the illustrated embodiment, the shoulder portion 318 has a curved surface extending from the face portion 316 to a radially outer shoulder edge 328 of the shoulder portion 318. That is, the shoulder portion 318 may be curved in a radial direction between the inner shoulder edge 326 and the corresponding outer shoulder edge 328 of the shoulder portion 318. In the illustrated embodiment, a radius of curvature of the curved surface of the shoulder portion 318 is constant. However, in some embodiments, the curved surface extending from the face portion 316 to a radially outer shoulder edge 328 may have a variable radius of curvature. Further, in the illustrated embodiment, the curved surface of the shoulder portion 318 is concave. In some embodiments, the shoulder portion 318 may include a planar surface 320 extending from the face portion 316 to the radially outer shoulder edge 328. Alternatively, the shoulder portion 318 may include a convex surface extending from the face portion 316 to the radially outer shoulder edge 328. However, forming the shoulder portion 318 with a concave surface may retain a larger portion of the residual compressive stresses in the plow feature 300 than planar and/or convex surfaces.

As set forth in greater detail below, a recessed portion 346 of the cutting face 312 extends from the radially outer shoulder edge 328 of the shoulder portion 318 to the cutting edge 314. In the illustrated embodiment, the cutting edge 314 has a greater axial height that the radially outer shoulder edge 328 of the shoulder portion 318. As such, the recessed portion 346 may extend in an axially upward direction away from the substrate 304 as the recessed portion 346 extends radially outward from the radially outer shoulder edge 328 of the shoulder portion 318 toward the cutting edge 314. That is, the recessed portion 346 may extend from the radially outer shoulder edge 328 of the shoulder portion 318 toward the cutting edge 314 at an angle. In some embodiments, the recessed portion 346 may be offset from the face portion 316 by an angle 350 that is less than ten degrees.

In some embodiments, the axial height of the cutting edge 314 may be constant. Indeed, the axial height of the cutting edge 314 may be a same axial height as the face portion 316 of the plow feature 300. Alternatively, the cutting edge 314 may include a variable axial height. For example, the cutting edge 314 may have a maximum axial height of the cutting edge 314 that is a same height as the face portion 316 and a minimum axial height of the cutting edge 314 that is less than the axial height of the face portion 316, but greater than an axial height of the radially outer shoulder edge 328 of the shoulder portion 318. The axial height may be measured as an axial distance from an interface 348 (e.g., an interface between the substrate 304 and the polycrystalline diamond portion 302) and a surface of a feature (e.g., the face portion 316, the shoulder portion 318, the recessed portion 346, the cutting edge 314, etc.)

As set forth above, the cutting edge 314 is formed at the transition from the cutting face 312 to the radial sidewall 308. The cutting edge 314 may be a straight edge (e.g., a ninety-degree edge). However, in the illustrated embodiment, the cutting edge 314 includes one or more chamfers. In some embodiments, the cutting edge 314 may also include a fillet.

Figure 4:
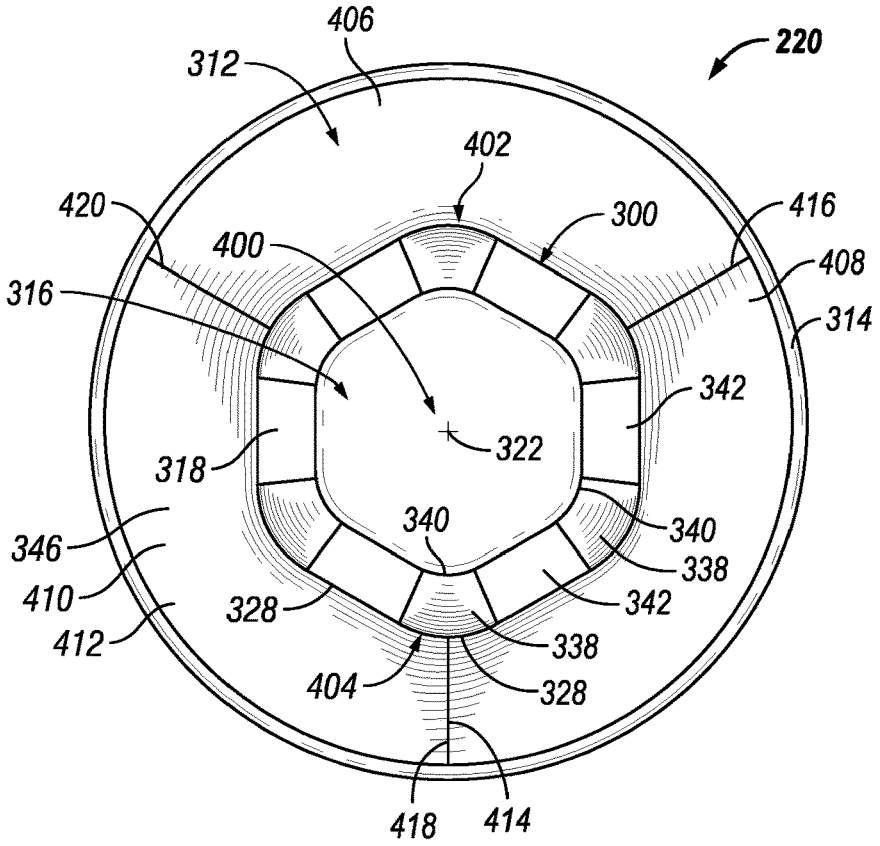
FIG. 4 illustrates a top view of the cutting element having the hexagonal plow feature, in accordance with some embodiments of the present disclosure.

FIG. 4 illustrates a top view of the cutting element 220 having the hexagonal plow feature 300, in accordance with some embodiments of the present disclosure. The cutting element 220 includes the cutting face 312 having the plow feature 300 with the face portion 316 and the shoulder portion 318 extending radially outward from the face portion 316. The plow feature 300 may include a face portion 316 having any suitable polygonal shape (e.g., triangular, square, etc.). In the illustrated embodiment, the face portion 316 has a hexagonal shape. As set forth above, the shoulder portion 318 may have a plurality of ridges 338 extending radially outward from respective face corners 340 of the hexagonal shaped face portion 316 to the radially outer shoulder edge 328 of the shoulder portion 318. Similarly, for plow features 300 having other polygonal shaped face portions 316, the shoulder portion 318 may also have a plurality of ridges 338 extending radially outward from respective face corners 340 of the correspondingly shaped face portion 316.

Moreover, the respective face corners 340 of the hexagonal shaped face portion 316 may be rounded or curved such that the plurality of ridges 338 may be rounded transitions formed in the shoulder portion 318 between the adjacent side portions 342. Further, a width of each of the ridges 338 may be based at least in part on a radius of the respective face corner 340. In some embodiments, the radius of each respective face corner 340 may be between 0.03 inches to 0.09 inches for a hexagonal shaped face portion 316 spanning 0.3 inches between opposite face corners 340 of the hexagonal shaped face portion 316. However, in some embodiments, the radius of each respective face corner 340 may be larger to help reduce fracturing of the plow feature 300 at the respective face corners 340 and/or ridges 338.

Further, the plow feature 300 may be sized with respect to the cutting face 312 to help reduce fracturing of the plow feature 300. As such, the plow feature 300 may be sized such that the respective face corners 340 of the face portion 316 are disposed proximate the cutting edge 314. Indeed, at least one face corner 340 of the polygonal shaped face portion 316 may be disposed between 50-90% of a radial distance between a center 400 of the face portion 316 and the cutting edge 314. Additionally, the shoulder portion 318 may span 55-95% of the diameter of the cutting element 220 from a first side 402 of the shoulder portion 318 to an opposite side (e.g., second side 404) of the shoulder portion 318. However, in some embodiments, at least one face corner 340 of the polygonal shaped face portion 316 may be disposed between 20-50% of a radial distance between the center 400 of the face portion 316 and the cutting edge 314. Additionally, the shoulder portion 318 may span 25-70% of the diameter of the cutting element 220 from the first side 402 of the shoulder portion 318 to the opposite side 404 of the shoulder portion 318. For example, the plow feature 300 may have a hexagonal shaped face portion 316 spanning substantially 0.15 inches from the center 400 of the hexagonal shaped face portion 316 to the face corner 340 for a cutting element 220 having a diameter of 0.615 inches.

Moreover, the cutting face 312 includes the recessed portion 346 extending from the radially outer shoulder edge 328 of the shoulder portion 318 to the cutting edge 314. In the illustrated embodiment, the recessed portion 346 includes three regions 412 (e.g., a first region 406, a second region 408, and a third region 410) that are symmetric about a central axis 322 of the cutting element 220. However, the recessed portion 346 may include any suitable number of regions 412 (e.g., two, four, five, six, etc.) Further, each region 412 of the recessed portion 346 may be planar. That is, each of the respective regions 412 may have a flat surface. The recessed portion 346 of each region 412 may extend linearly from the outer shoulder edge 328 of the shoulder portion 318 to the cutting edge 314. However, in some embodiments, the regions 412 of the recessed portion 346 may be non-planar (e.g., concave, convex, etc.). Further, the recessed portion 346 may include channels, grooves, or ridges in the surface of the recessed portion 346.

In the illustrated embodiment, the recessed portion 346 also includes at least three planar intersections 414 (e.g., a first planar intersection 416, a second planar intersection 418, and a third planar intersection 420) formed at boundaries between adjacent regions 412. For example, the first planar intersection 416 may be formed at a boundary between the first region 406 and the second region 408 of the at least three regions 412. As such, the number of planar intersections 414 is based on the number of regions 412 on the cutting face 312. The planar intersections 414 may extend radially outward from the outer shoulder edge 328 of the shoulder portion 318 to the cutting edge 314. Further, an axial height of the planar intersections 414 may increase in the direction from the outer shoulder edge 328 of the shoulder portion 318 to the cutting edge 314. In the illustrated embodiment, the planar intersections 414 are linear. However, in some embodiments, the planar intersections 414 may be curved (e.g., concave or convex).

Figure 5:
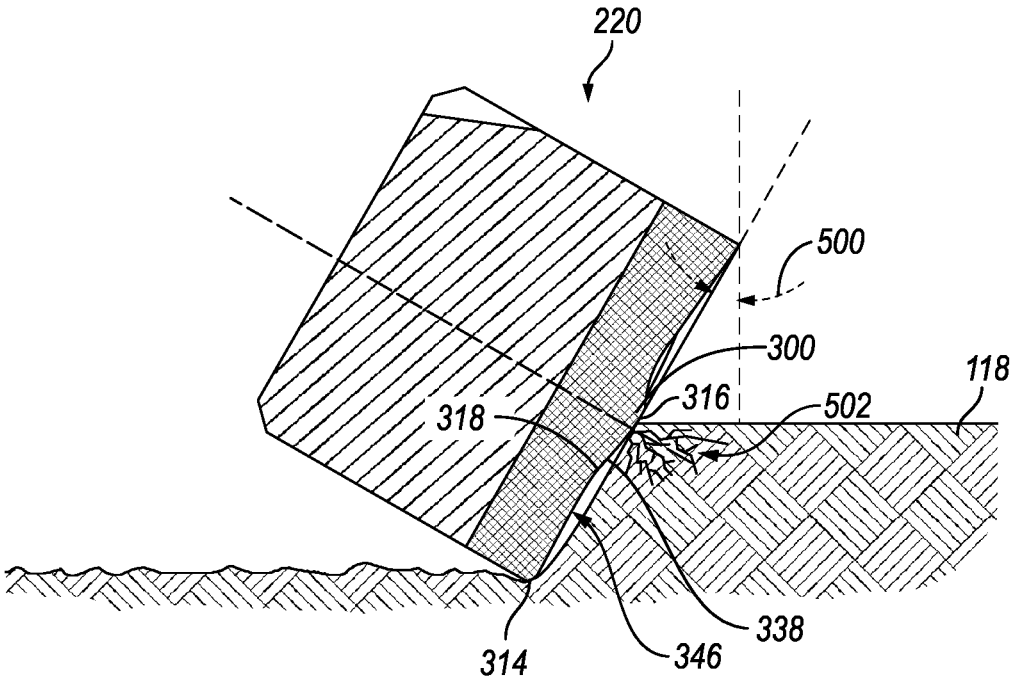
FIG. 5 illustrates a cross-sectional view of the cutting element engaging a downhole formation with the plow feature, in accordance with some embodiments of the present disclosure.

FIG. 5 illustrates a cross-sectional view of the cutting element 220 engaging the subterranean formation 118 with the plow feature 300, in accordance with some embodiments of the present disclosure. As set forth above, each cutting element 220 may be securely mounted to the drill bit 114 (shown in FIG. 2) at particular orientations to engage and remove portions of a subterranean formation 118 in a corresponding cutting path as the drill bit 114 rotates. In the illustrated embodiment, the cutting element 220 is oriented at a negative back rake angle 500. The negative back rake angle 500 may be between 0-45 degrees. Further, with the plow feature 300, having a negative back rake angle 500 may provide increase rate of penetration during drilling operations. However, in some embodiments, the cutting element 220 may be oriented with a neutral or positive back rake angle.

With the cutting element 220 oriented at a negative back rake angle 500, the plow feature 300 may engage portions of the subterranean formation 118 in advance of other portions of the cutting element 220 (e.g., the shoulder portion 318, the recessed portion 346, the cutting edge 314) engaging the subterranean formation 118. In some embodiments, at least one ridge 338 of the plurality of ridges 338 of the shoulder portion 318 of the plow feature 300 may be configured to engage the subterranean formation 118 to plow the formation material. Further, in some embodiments, a combination of the at least one ridge 338 and the face portion 316 may engage the subterranean formation 118 to plow the formation material. Moreover, as the plow feature 300 impacts the subterranean formation 118, the plow feature 300 may crush (e.g., fracture, crack, etc.) portions of the subterranean formation 118. Crushed formation material 502 may cause less wear on the other portions of the cutting element 220 configured to shear the subterranean formation 118. Thus, at the negative rake angle, the cutting edge 314, as well as portions of the cutting face 312 may shear the subterranean formation 118 after the plow feature 300 crushes a portion of the subterranean formation 118 such that the cutting element 220 experiences less wear during drilling operations.

Figure 6:
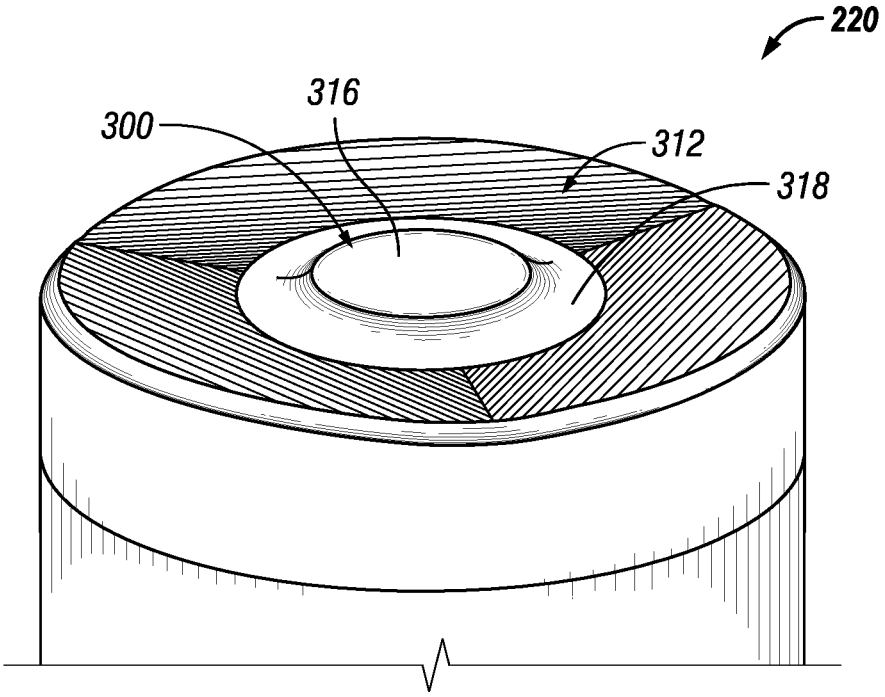
FIG. 6 illustrates a perspective view of the cutting element having a circular plow feature, in accordance with some embodiments of the present disclosure.

FIG. 6 illustrates a perspective view of the cutting element 220 having a circular plow feature 300, in accordance with some embodiments of the present disclosure. The cutting element 220 includes a cutting face 312 having the plow feature 300 with the face portion 316 and the shoulder portion 318 extending radially outward from the face portion 316. In the illustrated embodiment, the face portion 316 of the plow feature 300 has a circular shape. As set forth above, a circular plow feature 300 may provide less aggressive plowing than the hexagonal plow feature 300 shown in FIG. 3, but the circular plow feature 300 may be beneficial in reducing fracturing of the cutting element 220 from ablation lines (shown in FIG. 7) formed in the cutting face 312. As set forth above, material may be removed from the cutting face 312 to form the shoulder portion 318 and the recessed portion 346. In the illustrated embodiment, shoulder portion 318 and the recessed portion 346 may be formed by removing material from the cutting face 312 via laser ablation. During the removal process, the laser may form ablation lines (e.g., grooves) in the surface of the removed portions. In particular, the ablation lines may be formed along a path of the laser during the removal process. To remove the material for the cutting element 220 having the circular face portion 316, the laser may follow a curved path. As such, the ablation lines may form a non-linear pattern. During drilling operations, fracturing in the cutting element 220 may occur along ablation lines. Thus, having the ablation lines formed in a non-linear pattern may redirect fracture paths away from the center of the cutting element 220; thereby extending the wear life of the cutting element 220.

Figure 7:
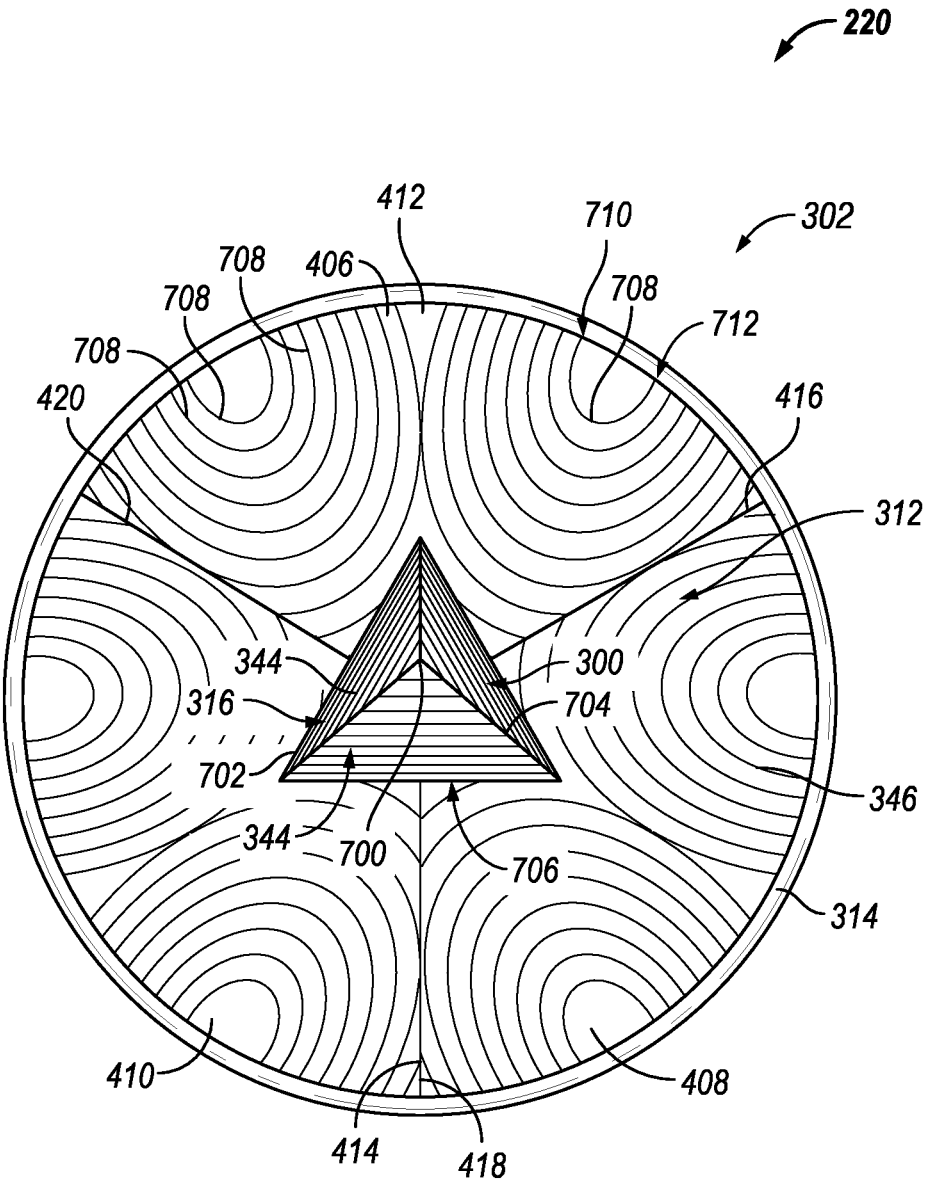
FIG. 7 illustrates a top view of the cutting element having a pyramidal plow feature, in accordance with some embodiments of the present disclosure.

FIG. 7 illustrates a top view of the cutting element 220 having a pyramidal plow feature 300, in accordance with some embodiments of the present disclosure. As illustrated, the cutting element 220 includes the cutting face 312 having a non-planar face portion 316. That is, the face portion 316 includes a variable height with respect to the substrate 304 (shown in FIG. 3) of the cutting element 220. In particular, the face portion 316 has a three-sided pyramidal shape. Each side 344 of the non-planar face portion 316 may extend downward from a tip 700 to a lower edge 702 of the face portion 316. In the illustrated embodiment, each side is planar. However, in some embodiments, the sides 344 may have curved surfaces (e.g., concave, convex, etc.). The non-planar face portion 316 may be formed by removing material from the cutting face 312 via laser ablation or any other suitable technique. Further, the sides 344 of the face portion 316 may be finished via lapping and/or laser ablation. The non-planar face portion 316 may be configured to engage the subterranean formation 118 to fracture portions of the formation in advance of other portions of the cutting element 220 (e.g., the recessed portion 346, the cutting edge 314, etc.) engaging the formation. The tip 700 of the face portion 316 may be configured to pierce the subterranean formation 118 such that face portion 316 and/or face ridges 704, formed at the transitions between the sides 344 of the face portion 316, may fracture the portions of the subterranean formation 118.

Further, the recessed portion 346 may include the regions 412 (e.g., the first region 406, the second region 408, and the third region 410) and the planar intersections 414 (e.g., the first planar intersection 416, the second planar intersection 418, and the third planar intersection 420) disposed at the boundaries between adjacent regions 412 of the at least three regions 412. In the illustrated embodiment, each planar intersection 414 extends radially outward toward the cutting edge 314 from a middle of the lower edge 702 of each side 344 of the face portion 316. Such alignment of the planar intersections 414 with respect to the sides 344 of the face portion 316 may reduce fracturing of the cutting face 312. Moreover, each region 412 of the recessed portion 346 may be planar. Further, as set forth above, the recessed portion 346 may be formed via laser ablation of the cutting face 312 of the polycrystalline diamond portion 302. In the illustrated embodiment, the ablation lines 708 are oriented to direct fractures away from the center of the cutting face 312. In particular, the ablation lines 708 may include a curved pattern extending from a first portion 710 of the cutting edge 314 toward the face portion 316 and back toward a second portion of the cutting edge 314. However, some ablation lines 708 may extend into the planar intersections 414 and/or the lower edges 702 of the face portion 316.

Figure 8:
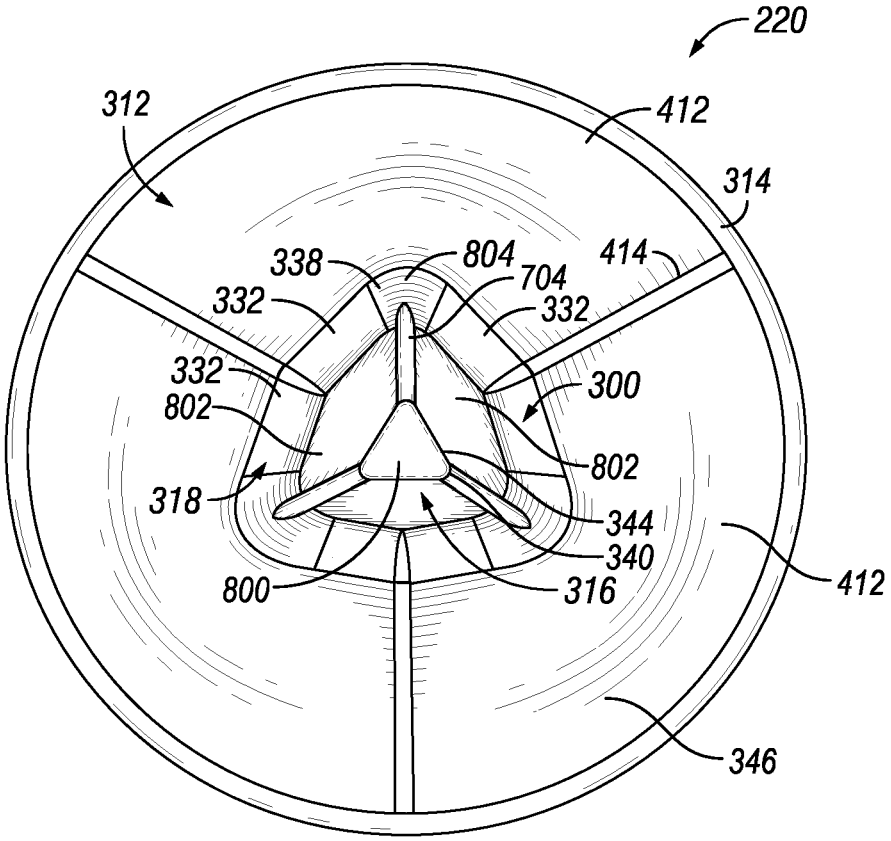
FIG. 8 illustrates a top view of the cutting element having a triangular plow feature, in accordance with some embodiments of the present disclosure.

FIG. 8 illustrates a top view of the cutting element 220 having a triangular plow feature 300, in accordance with some embodiments of the present disclosure. The cutting element 220 includes the cutting face 312 having the plow feature 300 with the face portion 316 and the shoulder portion 318 extending radially outward from the face portion 316. The face portion 316 and/or shoulder portion 318 may be configured to engage the subterranean formation 118 to plow the formation material.

As illustrated, the face portion 316 has a tip portion 800 and a plurality of side surfaces 802 extending radially outward and axially downward from the sides 344 of the tip portion 800. In the illustrated embodiment, the plurality of side surfaces 802 are planar. However, the plurality of side surfaces 802 may also be concave, convex, or otherwise curved. In the illustrated embodiment, the tip portion 800 has a planar surface. However, in some embodiment, the tip portion 800 may have any suitable surface. For example, the tip portion 800 may include channels or grooves in the surface of the tip portion 800. Alternatively, the tip portion 800 may have a non-planar surface (e.g., convex, etc.). Moreover, in the illustrated embodiment, tip portion 800 has a triangular shape, but may include any suitable geometric or freeform shape. As illustrated, the tip portion 800 having the triangular shape may include respective face corners 340. The face ridges 704 may extend radially outward and axially downward from respective face corners 340 such that the face ridges 704 form respective transitions between adjacent planar sides of the plurality of side surfaces 802. Further, the face corners 340 may be rounded or curved. In some embodiments, the face ridges 704 may extend linearly from the face corners 340 at an angle in the radially outward and/or axially downward directions. However, in some embodiments, the face ridges 704 may be concave, convex, or have another suitable curve.

Moreover, the shoulder portion 318 extends radially outward and axially downward from the plurality of side surfaces 802 and the plurality of face ridges 704. In particular, the plurality of ridges 338 (e.g., shoulder ridges 804) may extend radially outward and axially downward from the plurality of face ridges 704. The shoulder ridges 804 may have a convex surface. However, in some embodiments, the plurality of shoulder ridges 804 may include concave surfaces. Further, the plurality of shoulder sides 332 may extend radially outward and axially downward from the plurality of side surfaces 802 of the face portion 316. The shoulder ridges 804 may form transitions between adjacent shoulder sides of the plurality of shoulder sides 332. In the illustrated embodiment, the shoulder sides 804 are concave. However, the shoulder sides 804 may include any suitable shape.

The recessed portion 346 may extend radially outward and axially upward from the shoulder portion 318 to the cutting edge 314. That is, the regions 412 of the recessed portion 346 may extend radially outward and axially upward from the shoulder ridges 804 and the shoulder sides 332 of the shoulder portion 318. Further, as illustrated, the planar intersections 414 may be disposed between adjacent regions 412 of the recessed portion 346. In the illustrated embodiment, the planar intersections 414 have a curved surfaces. In particular, the planar intersections 414 have a convex surface extending from the shoulder portion 318 to the cutting edge 314 between adjacent regions 412. However, the planar intersections 414 may have a straight edge or other curved surfaces such as a concave surface.

Accordingly, the present disclosure may provide cutting elements with plow features for crushing subterranean formations in advance of other portions of the respective cutting faces of the cutting elements. The systems and methods may include any of the various features disclosed herein, including one or more of the following statements.

Statement 1. A cutting element may comprise a substrate configured to couple to a pocket formed in a blade of a downhole drill bit; and a polycrystalline diamond portion secured to the substrate, wherein the polycrystalline diamond portion includes a cutting face, a radial sidewall, and a cutting edge formed at a transition from the radial sidewall to the axial the cutting face, and wherein the cutting face comprises: a plow feature disposed at a center of the cutting face, the plow feature having a face portion and a shoulder portion, wherein the shoulder portion extends radially outward from the face portion and axially downward toward the substrate; and a recessed portion extending between the cutting edge and a radially outer edge of the shoulder portion.

Statement 2. The cutting element of statement 1, wherein the shoulder portion of the plow feature comprises a concave surface extending from the radially outer edge to the face portion.

Statement 3. The cutting element of statement 1 or statement 2, wherein the face portion of the plow feature comprises a hexagonal shape, and wherein the shoulder portion comprises a plurality of ridges extending radially outward from respective corners of the hexagonal shaped face portion to the radially outer edge of the shoulder portion.

Statement 4. The cutting element of statement 1 or statement 2, wherein the face portion of the plow feature comprises a circular shape.

Statement 5. The cutting element of any preceding statement, wherein a surface of the face portion of the plow feature is planar.

Statement 6. The cutting element of any preceding statement, wherein a surface of the face portion of the plow feature comprises a variable axial height relative the substrate.

Statement 7. The cutting element of any preceding statement, wherein the cutting edge has a variable axial height, wherein a maximum axial height of the cutting edge is a same height as the face portion, and wherein a minimum axial height of the cutting edge is a less than the axial height of the face portion.

Statement 8. The cutting element of any preceding statement, wherein the recessed portion comprises at least three regions that are symmetric about a central axis of the cutting element, and wherein each region of the recessed portion is planar.

Statement 9. The cutting element of any preceding statement, wherein the recess portion comprises at least three planar intersections formed at boundaries between the at least three regions, wherein each planar intersection extends radially outward from the shoulder portion to the cutting edge at an angle between 0-10 degrees.

Statement 10. The cutting element of any preceding statement, wherein the shoulder portion of the plow feature comprises a planar surface extending from the outer edge to the face portion.

Statement 11. The cutting element of any of statements 1-3 and 5-10, wherein the face portion of the plow feature comprises a polygonal shape, wherein the shoulder portion comprises a plurality of ridges extending radially outward from respective corners of the polygonal shaped face portion to the radially outer edge of the shoulder portion, and wherein at least one corner of the polygonal shaped face portion is disposed between 40-80% of a radial distance between the center of the face portion and the cutting edge.

Statement 12. The cutting element of any preceding statement, wherein the recessed portion is formed via laser ablation of the polycrystalline diamond portion.

Statement 13. The cutting element of any of statements 1, 2, 5, 6-10, and 12, wherein the face portion of the plow feature comprises a planar tip portion and a plurality of planar side surfaces extending radially outward from the planar tip portion, wherein the face portion further comprises a plurality of face ridges extending radially outward from respective corners of the planar tip portion, and wherein the shoulder portion extends radially outward from the plurality of planar side surfaces and the plurality of face ridges.

Statement 14. A drill bit may comprise a bit body; at least one blade attached to the bit body; at least one pocket formed in the at least one blade; at least one cutting element having a substrate coupled to the at least one pocket and a polycrystalline diamond portion secured to the substrate, wherein polycrystalline diamond portion includes a cutting face, a radial sidewall, and a cutting edge formed at a transition from the radial sidewall to the axial the cutting face, the cutting face comprising: a plow feature disposed at a center of the cutting face, the plow feature having a face portion and a shoulder portion, wherein the shoulder portion extends radially outward from the face portion and axially downward toward the substrate, and wherein the plow feature is configured to crush a portion of the subterranean formation to reduce stress on the cutting edge; and a recessed portion extending between the cutting edge and a radially outer edge of the shoulder portion.

Statement 15. The drill bit of statement 14, wherein the at least one pocket is oriented to position the at least one cutting element at a negative rake angle during drilling operations.

Statement 16. The drill bit of any of statements 14-15, wherein the negative rake angle is between 0-45 degrees.

Statement 17. The drill bit of any of statements 14-16, wherein the face portion of the plow feature comprises a polygonal shape, and wherein the shoulder portion comprises a plurality of ridges extending radially outward from respective corners of the hexagonal shaped face portion to the radially outer edge of the shoulder portion.

Statement 18. The drill bit of any of statements 14-17, wherein the respective corners are rounded such that the plurality of ridges forms curved transitions between adjacent sides of the shoulder portion, wherein the sides of the shoulder portion extend radially outward from respective sides of the hexagonal shaped face portion.

Statement 19. A method may comprise rotating a drill bit to extend a wellbore into a subterranean formation, wherein the drill bit comprises at least one cutting element disposed in a corresponding pocket formed in a blade of the drill bit, and wherein the at least one cutting element includes a plow feature formed in a cutting face of the at least one cutting element; plowing the geological formation with the plow feature of the at least one cutting element as the drill bit rotates to crush at least a portion of the geological formation, wherein the cutting element is positioned at a negative rake angle; and shearing at least the crushed portion of the geological formation with the cutting face of the cutting element.

Statement 20. The method of statement 19, wherein the plow feature is positioned at a center of the cutting face, the plow feature having a face portion and a shoulder portion, wherein the shoulder portion extends radially outward from the face portion and axially downward toward the substrate, and wherein a recessed portion extends radially outward from a radially outer edge of the shoulder portion to a cutting edge of the cutting face.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A cutting element, comprising:

a substrate configured to couple to a pocket formed in a blade of a downhole drill bit; and a polycrystalline diamond portion secured to the substrate, wherein the polycrystalline diamond portion includes a cutting face, a radial sidewall, and a cutting edge formed at a transition from the radial sidewall to the cutting face, and wherein the cutting face comprises:

a plow feature disposed at a center of the cutting face, the plow feature having a face portion and a shoulder portion, wherein the shoulder portion extends radially outward from the face portion and axially downward toward the substrate, wherein the shoulder portion comprises a plurality of ridges extending radially outward from the face portion to a radially outer edge of the shoulder portion, wherein the plurality of ridges comprises curved edges configured to engage a subterranean formation to plow formation material, and wherein the shoulder portion of the plow feature comprises a concave surface extending from the radially outer edge to the face portion; and a recessed portion extending between the cutting edge and the radially outer edge of the shoulder portion.

2. The cutting element of claim 1, wherein a surface of the face portion of the plow feature is planar.

3. The cutting element of claim 1, wherein a surface of the face portion of the plow feature comprises a variable axial height relative the substrate.

4. The cutting element of claim 1, wherein the cutting edge has a variable axial height, wherein a maximum axial height of the cutting edge is a same height as the face portion, and wherein a minimum axial height of the cutting edge is a less than the axial height of the face portion.

5. The cutting element of claim 1, wherein the recessed portion comprises at least three regions that are symmetric about a central axis of the cutting element, and wherein each region of the recessed portion is planar.

6. The cutting element of claim 5, wherein the recess portion comprises at least three planar intersections formed at boundaries between the at least three regions, wherein each planar intersection extends radially outward from the shoulder portion to the cutting edge at an angle between 0-10 degrees.

7. The cutting element of claim 1, wherein the shoulder portion of the plow feature comprises a planar surface extending from the outer edge to the face portion.

8. The cutting element of claim 1, wherein the face portion of the plow feature comprises a polygonal shape, wherein the plurality of ridges extend radially outward from respective corners of the polygonal shaped face portion to the radially outer edge of the shoulder portion, and wherein at least one corner of the polygonal shaped face portion is disposed between 40-80% of a radial distance between the center of the face portion and the cutting edge.

9. The cutting element of claim 1, wherein the recessed portion is formed via laser ablation of the polycrystalline diamond portion.

10. A cutting element, comprising:

a substrate configured to couple to a pocket formed in a blade of a downhole drill bit; and a polycrystalline diamond portion secured to the substrate, wherein the polycrystalline diamond portion includes a cutting face, a radial sidewall, and a cutting edge formed at a transition from the radial sidewall to the cutting face, and wherein the cutting face comprises:

a plow feature disposed at a center of the cutting face, the plow feature having a face portion and a shoulder portion, wherein the shoulder portion extends radially outward from the face portion and axially downward toward the substrate, wherein the shoulder portion comprises a plurality of ridges extending radially outward from the face portion to a radially outer edge of the shoulder portion, wherein the plurality of ridges comprises curved edges configured to engage a subterranean formation to plow formation material, and wherein the face portion of the plow feature comprises a hexagonal shape, and wherein the plurality of ridges extend radially outward from respective corners of the hexagonal shaped face portion to the radially outer edge of the shoulder portion; and a recessed portion extending between the cutting edge and the radially outer edge of the shoulder portion.

11. A cutting element, comprising:

a substrate configured to couple to a pocket formed in a blade of a downhole drill bit; and a polycrystalline diamond portion secured to the substrate, wherein the polycrystalline diamond portion includes a cutting face, a radial sidewall, and a cutting edge formed at a transition from the radial sidewall to the cutting face, and wherein the cutting face comprises:

a plow feature disposed at a center of the cutting face, the plow feature having a face portion and a shoulder portion, wherein the shoulder portion extends radially outward from the face portion and axially downward toward the substrate, wherein the shoulder portion comprises a plurality of ridges extending radially outward from the face portion to a radially outer edge of the shoulder portion, wherein the plurality of ridges comprises curved edges configured to engage a subterranean formation to plow formation material, and wherein the face portion of the plow feature comprises a planar tip portion and a plurality of planar side surfaces extending radially outward from the planar tip portion, wherein the face portion further comprises a plurality of face ridges extending radially outward from respective corners of the planar tip portion, and wherein the shoulder portion extends radially outward from the plurality of planar side surfaces and the plurality of face ridges; and a recessed portion extending between the cutting edge and the radially outer edge of the shoulder portion.

12. A drill bit, comprising:

a bit body;

at least one blade attached to the bit body;

at least one pocket formed in the at least one blade;

at least one cutting element having a substrate coupled to the at least one pocket and a polycrystalline diamond portion secured to the substrate, wherein polycrystalline diamond portion includes a cutting face, a radial sidewall, and a cutting edge formed at a transition from the radial sidewall to the cutting face, the cutting face comprising:

a plow feature disposed at a center of the cutting face, the plow feature having a face portion and a shoulder portion, wherein the shoulder portion extends radially outward from the face portion and axially downward toward the substrate, wherein the shoulder portion comprises a plurality of ridges extending radially outward from the face portion to a radially outer edge of the shoulder portion, wherein the plurality of ridges comprises curved edges configured to engage a subterranean formation to plow formation material, and wherein the plow feature is configured to crush a portion of a subterranean formation to reduce stress on the cutting edge; and a recessed portion extending between the cutting edge and a radially outer edge of the shoulder portion.

13. The drill bit of claim 12, wherein the at least one pocket is oriented to position the at least one cutting element at a negative rake angle during drilling operations.

14. The drill bit of claim 13, wherein the negative rake angle is between 0-45 degrees.

15. The drill bit of claim 12, wherein the face portion of the plow feature comprises a polygonal shape, and wherein the plurality of ridges extend radially outward from respective corners of the polygonal shaped face portion to the radially outer edge of the shoulder portion.

16. The drill bit of claim 15, wherein the respective corners are rounded such that the plurality of ridges forms curved transitions between adjacent sides of the shoulder portion, wherein the sides of the shoulder portion extend radially outward from respective sides of the polygonal shaped face portion, wherein the polygonal shaped face portion comprises a hexagonal shaped portion.

17. A method comprising:

rotating a drill bit to extend a wellbore into a subterranean formation, wherein the drill bit comprises at least one cutting element disposed in a corresponding pocket formed in a blade of the drill bit, and wherein the at least one cutting element includes a plow feature formed in a cutting face of the at least one cutting element, the plow feature having a face portion and a shoulder portion, wherein the shoulder portion comprises a plurality of ridges extending radially outward from the face portion to a radially outer edge of the shoulder portion, wherein the plurality of ridges comprises curved edges configured to engage the subterranean formation to plow formation material;

plowing the subterranean formation with the plow feature of the at least one cutting element as the drill bit rotates to crush at least a portion of the subterranean formation, wherein the cutting element is positioned at a negative rake angle; and shearing at least the crushed portion of the subterranean formation with the cutting face of the cutting element.

18. The method of claim 17, wherein the plow feature is positioned at a center of the cutting face, wherein the shoulder portion extends radially outward from the face portion and axially downward toward a substrate, and wherein a recessed portion extends radially outward from a radially outer edge of the shoulder portion to a cutting edge of the cutting face.

* * * * *